US012324524B2

(12) United States Patent
Xie et al.

(10) Patent No.: US 12,324,524 B2
(45) Date of Patent: Jun. 10, 2025

(54) AIR MATTRESS

(71) Applicant: Foshan Tiansheng Leisure and Sports Goods Co. Ltd., Foshan (CN)

(72) Inventors: Guangyang Xie, Foshan (CN); Yongshan Liu, Foshan (CN); Guoming Zhang, Foshan (CN); Jinjian Tan, Foshan (CN); Zuoyou Xie, Foshan (CN)

(73) Assignee: Foshan Tiansheng Leisure and Sports Goods Co. Ltd., Foshan (CN)

( * ) Notice: Subject to any disclaimer, the term of this patent is extended or adjusted under 35 U.S.C. 154(b) by 204 days.

(21) Appl. No.: 18/357,178

(22) Filed: Jul. 24, 2023

(65) Prior Publication Data

US 2024/0164537 A1 May 23, 2024

(30) Foreign Application Priority Data

Nov. 23, 2022 (CN) ..... 202223117691.2

(51) Int. Cl.
*A47C 27/08* (2006.01)
*A47C 27/00* (2006.01)

(52) U.S. Cl.
CPC ..... *A47C 27/081* (2013.01); *A47C 27/087* (2013.01); *A47C 27/08* (2013.01)

(58) Field of Classification Search
CPC ... A47C 27/081; A47C 27/082; A47C 27/087; A47C 27/08; A47C 27/10; A61G 7/05769; A61G 7/05776
USPC ..... 5/706, 710–713, 654, 655.3, 644
See application file for complete search history.

(56) References Cited

U.S. PATENT DOCUMENTS 2,919,747 A * 1/1960 Post ..... A47C 27/081 156/227
4,541,135 A * 9/1985 Karpov ..... A47C 27/087 5/710
6,954,957 B2 10/2005 Metzger et al.
7,406,735 B2 * 8/2008 Lin ..... A47C 27/081 5/711
7,591,036 B2 * 9/2009 Lin ..... A47C 27/081 5/713
7,627,910 B2 * 12/2009 Davis ..... A61G 7/103 5/81.1 R (Continued)

FOREIGN PATENT DOCUMENTS

EP 4173525 A1 * 5/2023 ..... A47C 17/86

*Primary Examiner* — Robert G Santos
(74) *Attorney, Agent, or Firm* — True Shepherd LLC; Andrew C. Cheng

(57) ABSTRACT

An air mattress includes a top sheet, a bottom sheet, an annular outer side wall, an annular inner side wall, a plurality of inner pull straps, and a plurality of outer pull straps. An upper edge and a lower edge of the annular outer side wall are connected to outer edges of the top sheet and the bottom sheet respectively to form an inflatable chamber of the air mattress, the annular inner side wall divides the inflatable chamber into an inner inflatable chamber and an outer inflatable chamber, and the inner inflatable chamber communicates with the outer inflatable chamber. The plurality of outer pull straps are spaced between the annular outer side wall and the annular inner side wall, and the plurality of inner pull straps are arranged between the top sheet and the bottom sheet.

9 Claims, 4 Drawing Sheets

(56) References Cited

U.S. PATENT DOCUMENTS

| | | | | |
|---|---|---|---|---|
| 7,636,970 | B2 * | 12/2009 | Lin | A47C 27/081 5/713 |
| 8,387,177 | B2 * | 3/2013 | Davis | A61G 7/1028 5/81.1 R |
| 9,635,953 | B2 | 5/2017 | Nunn et al. | |
| 9,844,275 | B2 | 12/2017 | Nunn et al. | |
| 2007/0283499 | A1 * | 12/2007 | Lin | A47C 27/081 5/713 |
| 2008/0209642 | A1 * | 9/2008 | Lin | A47C 27/087 5/713 |
| 2008/0209643 | A1 * | 9/2008 | Lin | A47C 27/081 5/713 |
| 2008/0289102 | A1 * | 11/2008 | Davis | A61G 7/0504 5/81.1 R |
| 2010/0024123 | A1 * | 2/2010 | Davis | A61G 1/013 5/81.1 R |
| 2023/0132601 | A1 * | 5/2023 | Huang | A47C 27/087 5/710 |
| 2024/0164537 | A1 * | 5/2024 | Xie | A47C 27/087 |
| 2024/0188727 | A1 * | 6/2024 | Yao | A47C 27/087 |

* cited by examiner

AIR MATTRESS

CROSS-REFERENCE TO RELATED APPLICATIONS

This application claims priority to Chinese Patent Application No. 202223117691.2 with a filing date of Nov. 23, 2022. The content of the aforementioned application, including any intervening amendments thereto, is incorporated herein by reference.

TECHNICAL FIELD

The present disclosure relates to the technical field of inflatable products, and in particular, to an air mattress.

BACKGROUND

Air mattresses are popular among consumers because of the advantages that the air mattresses are light in weight, easy to store and not prone to deformation, and can be folded after being deflated to be portable. The air mattresses are widely used as portable mattresses for camping or spare mattresses for guests at home.

Air mattresses of different heights are used in different occasions. Low air mattresses are often used for outdoor camping, while high air mattresses are generally used at home. An existing air mattress is made of a flexible proof sheet, and a surface of the mattress may expand outwards under the pressure of gas after inflation. Therefore, the existing air mattress is usually equipped with an inner pull strap, and two ends of the inner pull strap are connected to a top sheet and a bottom sheet of the mattress respectively to limit a surface shape of the air mattress. In this way, a top surface of the mattress is flat, and thus a back of a user can be closely fit with the mattress surface after the user lies down. However, the existing air mattress does not have ideal restrictions on the outward expansion of a side wall, making the side wall of the air mattress has an obviously outward protruding cambered surface after being inflated, which affects the smoothness of the mattress surface and strength of a corresponding position.

SUMMARY OF PRESENT INVENTION

The objective of the present disclosure is to provide an air mattress, to solve at least one technical problem described in the above background.

In order to achieve the above objective, the present disclosure adopts the following technical solution:

An air mattress includes a top sheet, a bottom sheet, an annular outer side wall, an annular inner side wall, a plurality of inner pull straps, and a plurality of outer pull straps, where an upper edge and a lower edge of the annular outer side wall are connected to outer edges of the top sheet and the bottom sheet respectively to form an inflatable chamber of the air mattress, the annular inner side wall is connected to a bottom surface of the top sheet and a top surface of the bottom sheet, the annular inner side wall is arranged on an inner side of the annular outer side wall, the annular inner side wall divides the inflatable chamber into an inner inflatable chamber and an outer inflatable chamber, and the inner inflatable chamber communicates with the outer inflatable chamber; and the plurality of inner pull straps are evenly arranged in the inner inflatable chamber, two ends of the inner pull strap are connected to a top surface of the top sheet and the top surface of the bottom sheet respectively, the plurality of outer pull straps are spaced in the outer inflatable chamber, the outer pull straps are tubular pull straps, and pipe walls at two opposite ends of the tubular pull strap are connected to the annular inner side wall and the annular outer side wall by annular weld seams, respectively.

Preferably, the annular outer side wall is connected to the top sheet, the bottom sheet and the outer pull strap through high-frequency welding, the annular inner side wall is connected to the top sheet and the bottom sheet through high-frequency welding, and the inner pull strap is connected to the top sheet and the bottom sheet through high-frequency welding.

Preferably, the annular inner side wall has air holes for communicating the inner inflatable chamber with the outer inflatable chamber.

Preferably, the inner pull strap is at least one of a straight pull strap, a wavy pull strap or a tubular pull strap.

Preferably, the annular weld seam is in the shape of at least one of a circle, an ellipse or a rectangle with rounded corners.

Preferably, the annular outer side wall and the annular inner side wall have a cross-section shape of a rectangle with rounded corners.

Preferably, a plurality of tubular pull straps is spaced along a length direction and a width direction of the air mattress respectively.

Preferably, two tubular pull straps opposite to each other are arranged along a length direction and another two tubular pull straps opposite to each other are arranged along a width direction of the air mattress respectively.

Preferably, an outer surface of the top sheet or an outer surface of the bottom sheet or an outer surface of the annular outer side wall has a flocking layer or a fabric layer.

Compared with the prior art, the present disclosure has the beneficial effects that the plurality of outer pull straps are spaced between the annular outer side wall and the annular inner side wall, and the plurality of inner pull straps are arranged between the top sheet and the bottom sheet, so that the plurality of outer pull straps and the plurality of inner pull straps are in a tensioned state after the outer inflatable chamber and the inner inflatable chamber are both inflated, thereby limiting outward expansion of the annular outer side wall, the top sheet and the bottom sheet, enabling a side surface, a top surface and a bottom surface of the air mattress to form a relatively flat appearance, and ensuring strength of connection between the annular outer side wall and the top sheet and between the annular outer side wall and the bottom sheet. In addition, the present disclosure is simple in structure and convenient to machine, and can obviously improve production efficiency and reduce costs.

BRIEF DESCRIPTION OF THE DRAWINGS

The accompanying drawings further describe the present disclosure. However, the contents in the accompanying drawings do not form any limit to the present disclosure.

DETAILED DESCRIPTION OF THE EMBODIMENTS

The technical solutions of the present disclosure will be further described below with reference to the accompanying drawings and specific implementations.

Figure 1:
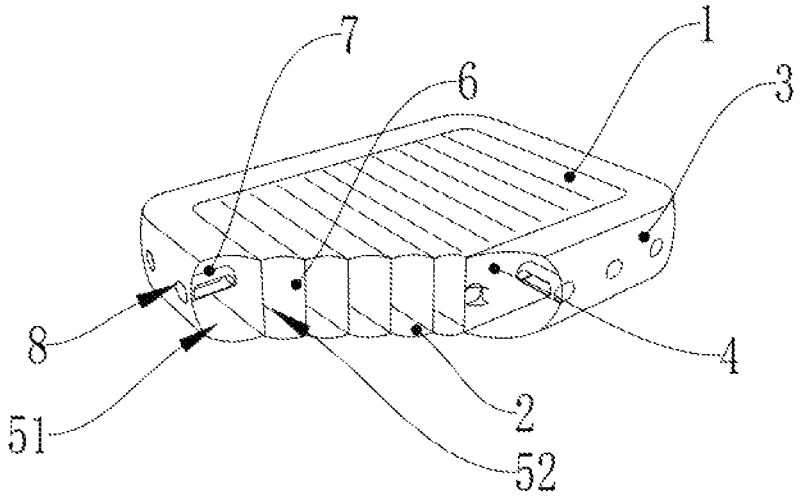
FIG. 1 is a schematic partial sectional view showing that a plurality of outer pull straps are spaced in an outer inflatable chamber along a length direction and a width direction of an air mattress respectively and a plurality of straight pull straps are arranged in an inner inflatable chamber according to an embodiment of the present disclosure.

Referring to FIG. 1, an air mattress according to this embodiment includes a top sheet 1, a bottom sheet 2, an annular outer side wall 3, an annular inner side wall 4, a plurality of inner pull straps 6, and a plurality of outer pull straps 7, where the annular inner side wall 4 is arranged in the annular outer side wall 3, an upper edge and a lower edge of the annular outer side wall 3 are connected to outer edges of the top sheet 1 and the bottom sheet 2 respectively to form an inflatable chamber of the air mattress, the annular inner side wall 4 is connected to a bottom surface of the top sheet 1 and a top surface of the bottom sheet 2, the annular inner side wall 4 is arranged on an inner side of the annular outer side wall 3, the annular inner side wall 4 divides the inflatable chamber into an inner inflatable chamber 52 and an outer inflatable chamber 51, and the inner inflatable chamber 52 communicates with the outer inflatable chamber 51; and the plurality of inner pull straps 6 are evenly arranged in the inner inflatable chamber 52, an upper end and a lower end of the inner pull strap 6 are connected to a bottom surface of the top sheet 1 and the top surface of the bottom sheet 2 respectively, the plurality of outer pull straps 7 are spaced in the outer inflatable chamber 51, the outer pull straps 7 are tubular pull straps, and pipe walls at two opposite ends of the tubular pull strap are connected to the annular inner side wall 4 and the annular outer side wall 3 by annular weld seams 8, respectively.

In this embodiment, the plurality of outer pull straps 7 are spaced between the annular outer side wall 3 and the annular inner side wall 4, and the plurality of inner pull straps 6 are arranged between the top sheet 1 and the bottom sheet 2, so that the plurality of outer pull straps 7 and the plurality of inner pull straps 6 are in a tensioned state after the outer inflatable chamber 51 and the inner inflatable chamber 52 are both inflated, thereby limiting outward expansion of the annular outer side wall 3, the top sheet 1 and the bottom sheet 2, enabling a side surface, a top surface and a bottom surface of the air mattress to form a relatively flat appearance, and ensuring strength of connection between the annular outer side wall 3 and the top sheet 1 and between the annular outer side wall and the bottom sheet 2. In addition, the present disclosure is simple in structure and convenient to machine, and can obviously improve production efficiency and reduce costs.

Preferably, the annular outer side wall 3 is connected to the top sheet 1, the bottom sheet 2 and the outer pull strap 7 through high-frequency welding, the annular inner side wall 4 is connected to the top sheet 1 and the bottom sheet 2 through high-frequency welding, and the inner pull strap 6 is connected to the top sheet 1 and the bottom sheet 2 through high-frequency welding. In this embodiment, high-frequency welding is used to connect the annular outer side wall 3 to the top sheet 1, the bottom sheet 2 and the outer pull strap 7, connect the annular inner side wall 4 to the top sheet 1, the bottom sheet 2 and the outer pull strap 7, and connect the inner pull strap 6 to the top sheet 1 and the bottom sheet 2, thereby ensuring the strength of connection between connection parts of the air mattress, facilitating machining and achieving high machining efficiency.

Preferably, the annular inner side wall 4 has air holes for communicating the inner inflatable chamber 52 with the outer inflatable chamber 51. The communication between the inner inflatable chamber 52 and the outer inflatable chamber 51 is realized by providing the air holes in the annular inner side wall 4, so that when the outer inflatable chamber 51 is inflated, gas can flow into the inner inflatable chamber 52 to inflate the inner inflatable chamber 52.

Preferably, the inner pull strap 6 is at least one of a straight pull strap, a wavy pull strap or a tubular pull strap. A weld seam after the connection of the inner pull strap 6 to the top sheet and the bottom sheet is in the shape of a straight strip, a wavy strip or a circular hole. Therefore, a straight pull strap (referring to FIG. 1 and FIG. 2), a wavy pull strap (referring to FIG. 3) or a tubular pull strap (referring to FIG. 4) may be selected based on actual appearance or support strength requirements to meet user needs.

Preferably, the annular weld seam 8 is in the shape of at least one of a circle, an ellipse or a rectangle with rounded corners. The annular weld seam 8 can prevent excessive stress concentration and prevent welding positions between the outer pull strap 7 and the annular outer side wall 3 and the outer pull strap and the annular inner side wall 4 from being damaged easily.

Preferably, the annular outer side wall 3 and the annular inner side wall 4 have a cross-section shape of a rectangle with inverted rounded corners. This enables parts at which the annular outer side wall 3 and the annular inner side wall 4 are connected to the top sheet 1 and the bottom sheet 2 to be smoother, thereby preventing ease of damage during inflation caused by excessive stress concentration.

Preferably, an air valve or an electric air pump that can inflate or deflate the outer inflatable chamber 51 is arranged on the annular outer side wall 3. The inflation or deflation of the air mattress is facilitated through the arrangement of the air valve or the electric air pump.

Figure 3:
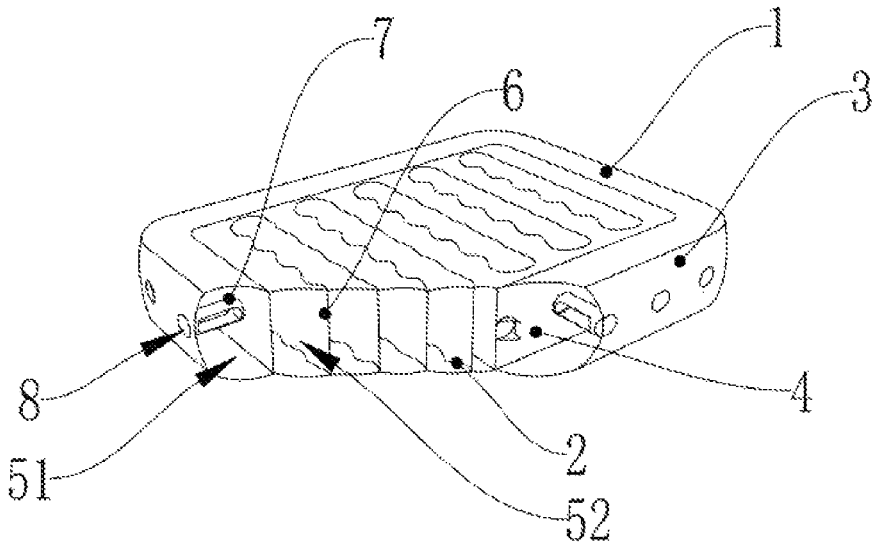
FIG. 3 is a schematic partial sectional view showing that a plurality of outer pull straps are spaced in an outer inflatable chamber along a length direction and a width direction of an air mattress respectively and a plurality of wavy pull straps are arranged in an inner inflatable chamber according to an embodiment of the present disclosure.

Preferably, a plurality of tubular pull straps 7 (as shown in FIG. 1 and FIG. 3) are spaced along a length direction and a width direction of the air mattress respectively.

Figure 2:
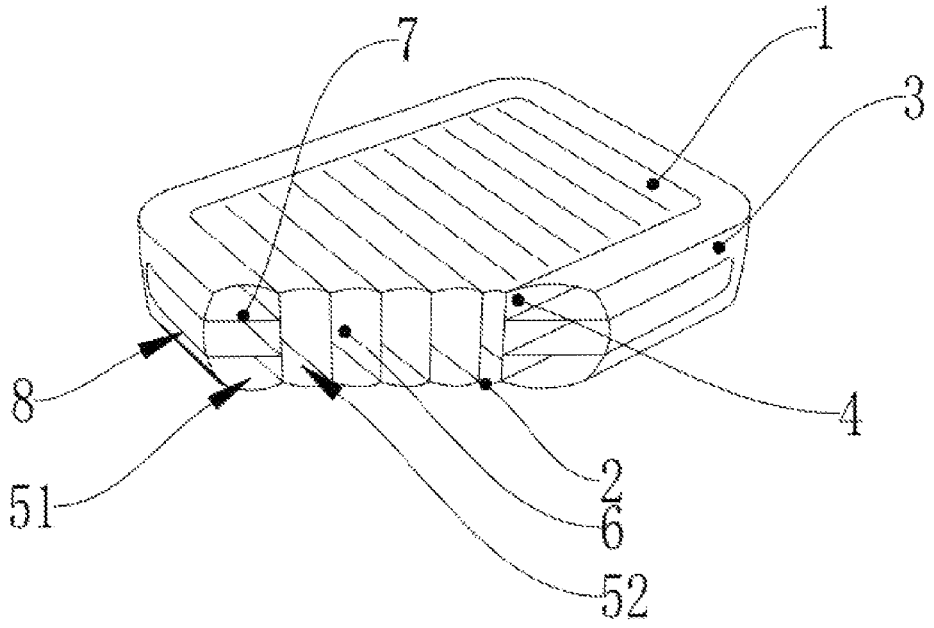
FIG. 2 is a schematic partial sectional view showing respective arrangement of two tubular pull straps opposite to each other in an outer inflatable chamber along a length direction and a width direction of an air mattress according to an embodiment of the present disclosure.
Figure 4:
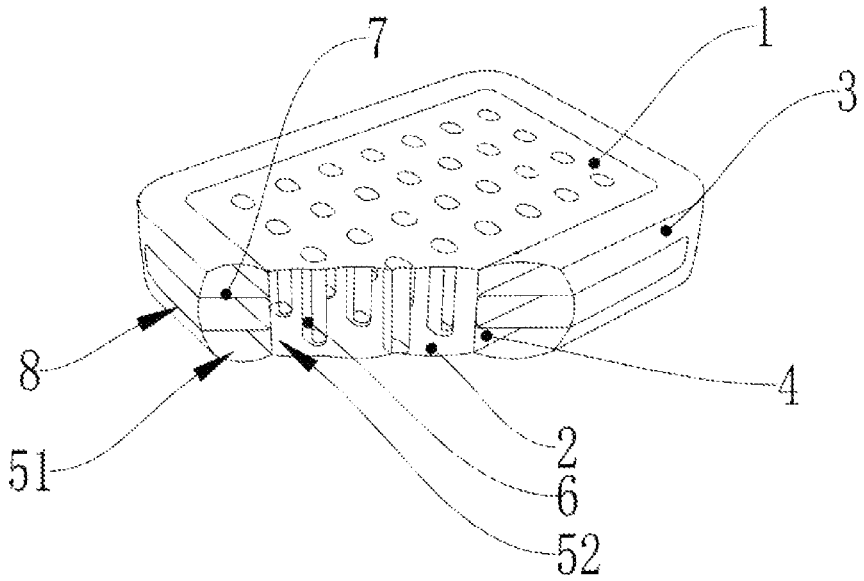
FIG. 4 is a schematic partial sectional view showing that two tubular pull straps opposite to each other are arranged in an outer inflatable chamber along a length direction and a width direction of an air mattress respectively and a plurality of tubular pull straps are arranged in an inner inflatable chamber according to an embodiment of the present disclosure.

Preferably, two tubular pull straps 7 (as shown in FIG. 2 and FIG. 4) opposite to each other are arranged along a length direction and a width direction of the air mattress respectively.

Preferably, an outer surface of the top sheet 1 or an outer surface of the bottom sheet 2 or an outer surface of the annular outer side wall 3 has a flocking layer or a fabric layer. This improves use comfort of the air mattress.

The technical principles of the present disclosure are described above with reference to the specific embodiments.

These descriptions are merely intended to explain the principles of the present disclosure, and cannot be construed as limiting the protection scope of the present disclosure in any way. Based on the explanation herein, those skilled in the art may associate other specific implementations of the present disclosure without creative effort, and these implementations should fall within the protection scope of the present disclosure.

What is claimed is:

1. An air mattress, comprising a top sheet, a bottom sheet, an annular outer side wall, an annular inner side wall, a plurality of inner pull straps, and a plurality of outer pull straps, wherein an upper edge and a lower edge of the annular outer side wall are connected to outer edges of the top sheet and the bottom sheet respectively to form an inflatable chamber of the air mattress, the annular inner side wall is connected to a bottom surface of the top sheet and a top surface of the bottom sheet, the annular inner side wall is arranged on an inner side of the annular outer side wall, the annular inner side wall divides the inflatable chamber into an inner inflatable chamber and an outer inflatable chamber, and the inner inflatable chamber communicates with the outer inflatable chamber; and the plurality of inner pull straps are arranged in the inner inflatable chamber, two ends of each inner pull strap are connected to a bottom surface of the top sheet and the top surface of the bottom sheet respectively, the plurality of outer pull straps are spaced in the outer inflatable chamber, the outer pull straps are tubular pull straps, and pipe walls at two opposite ends of each tubular pull strap are connected to the annular inner side wall and the annular outer side wall by annular weld seams, respectively.

2. The air mattress according to claim 1, wherein the annular outer side wall is connected to the top sheet, the bottom sheet and the outer pull straps through high-frequency welding, the annular inner side wall is connected to the top sheet and the bottom sheet through high-frequency welding, and the inner pull straps are connected to the top sheet and the bottom sheet through high-frequency welding.

3. The air mattress according to claim 1, wherein the annular inner side wall has air holes for communicating the inner inflatable chamber with the outer inflatable chamber.

4. The air mattress according to claim 1, wherein the inner pull straps are at least one of straight pull straps, wavy pull straps or tubular pull straps.

5. The air mattress according to claim 1, wherein the annular weld seams are in a shape of at least one of a circle, an ellipse or a rectangle with rounded corners.

6. The air mattress according to claim 1, wherein the annular outer side wall and the annular inner side wall have a cross-section shape of a rectangle with rounded corners.

7. The air mattress according to claim 1, wherein a plurality of tubular pull straps are spaced along a length direction and a width direction of the air mattress respectively.

8. The air mattress according to claim 1, wherein two tubular pull straps opposite to each other are arranged along a length direction and another two tubular pull straps opposite to each other are arranged along a width direction of the air mattress.

9. The air mattress according to claim 1, wherein an outer surface of the top sheet or an outer surface of the bottom sheet or an outer surface of the annular outer side wall has a flocking layer or a fabric layer.

* * * * *